US005942851A

United States Patent [19]

Filmer et al.

[11] Patent Number: 5,942,851

[45] Date of Patent: Aug. 24, 1999

[54] LOW-PRESSURE SODIUM DISCHARGE LAMP WITH SPECIFIC CURRENT SUPPLY COATINGS

[75] Inventors: Bartholomeus Filmer, Lommel, Belgium; Petrus M.G. Van Gennip, Eindhoven, Netherlands

[73] Assignee: U.S. Philips Corporation, New York, N.Y.

[21] Appl. No.: 08/985,980

[22] Filed: Dec. 5, 1997

[30] Foreign Application Priority Data

Dec. 9, 1996 [EP] European Pat. Off. ..... 96203481

[51] Int. Cl.[6] ..... H01J 17/18

[52] U.S. Cl. ..... 313/623; 313/624; 313/626

[58] Field of Search ..... 313/573, 634, 313/635, 636, 637, 638, 639, 623, 624, 626

[56] References Cited

U.S. PATENT DOCUMENTS 4,390,637 6/1983 Daiku ..... 501/64
4,459,510 7/1984 Joormann ..... 313/636
4,783,612 11/1988 Sprengers ..... 313/331
5,498,927 3/1996 Vervecken et al. ..... 313/623

FOREIGN PATENT DOCUMENTS 4933870 3/1988 Japan ..... H01J 61/36

*Primary Examiner*—Vip Patel
*Assistant Examiner*—Matthew J. Gerike
*Attorney, Agent, or Firm*—F. Brice Faller

[57] ABSTRACT

The low pressure sodium discharge lamp has a discharge vessel (1) having pinch seals (2) through which current conductors (4) extend towards electrodes (3) inside the discharge vessel (1). The current conductors (4) each have a first glass coating (5), which extends from inside a pinch seal (2) into the discharge vessel (1) and a second lime glass coating (6) abutting the first (5) and extending to outside the discharge vessel (1). A new first sodium resistant glass coating (5), which is substantially devoid of borate, is defined.

3 Claims, 2 Drawing Sheets

LOW-PRESSURE SODIUM DISCHARGE LAMP WITH SPECIFIC CURRENT SUPPLY COATINGS

Figure 1:
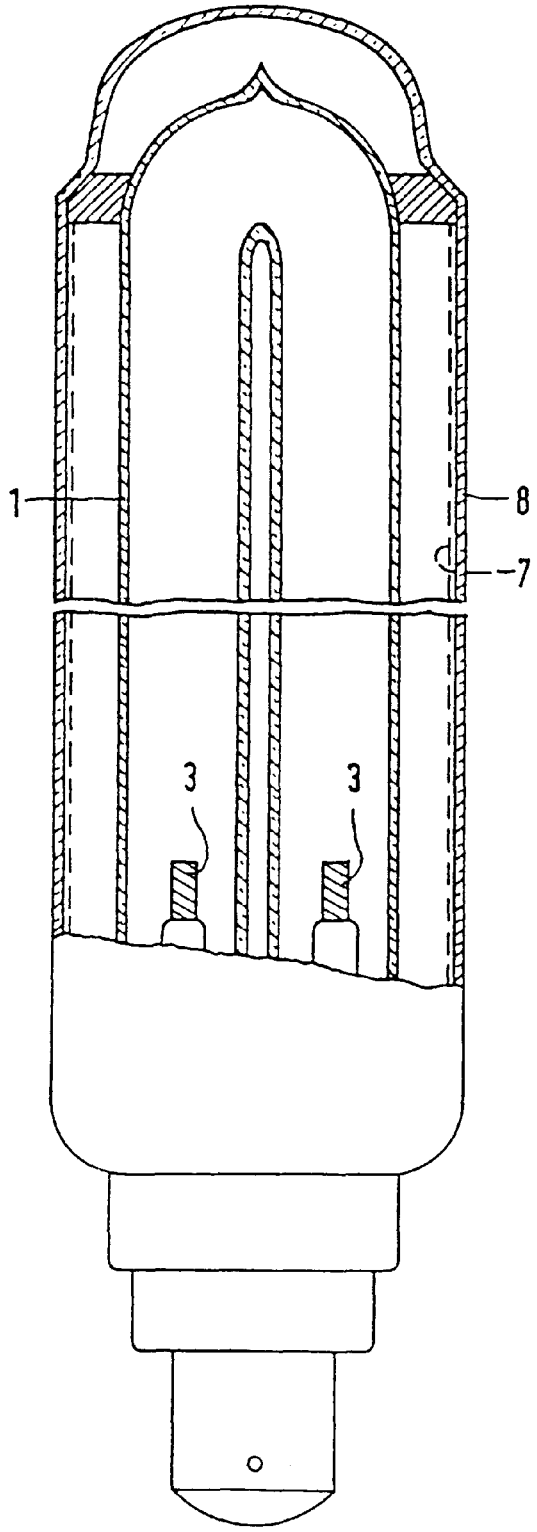

The invention relates to a low-pressure sodium discharge lamp comprising:

a discharge vessel with pinch seals which is closed in a vacuumtight manner and which has a filling comprising sodium and rare gas;

electrodes arranged in the discharge vessel and each connected to at least one corresponding current conductor which issues through a pinch seal to the exterior, which current conductors each have a first, comparatively thin glass coating which extends from the relevant pinch seal to inside the discharge vessel, and a second, comparatively thick coating of lime-barium glass abutting the first coating and extending from said pinch seal to outside the discharge vessel; and an evacuated outer bulb surrounding the discharge vessel and provided with an IR reflection filter.

Such a low-pressure sodium discharge lamp is known from U.S. Pat. No. 4,783,612.

The first, comparatively thin, for example approximately 0.3 mm thick and mechanically comparatively weak coating protects the current conductors against electrical contact with solid or liquid sodium which is deposited against the pinch seal. It is prevented thereby that the discharge arc applies itself to the sodium during lamp operation and leads to violent reactions which may result in damage to the current conductor and to the pinch seal. The glass of the first coating comprises some tens of percents by weight of boron oxide and in addition more than 50% by weight of barium oxide, but only a few percents of silicon oxide. The glass is resistant to sodium in the case of operation at mains frequency.

The second, comparatively thick, for example approximately 0.7 mm thick coating serves to provide the current conductor with a mechanically strong envelope, absorbing the difference in coefficient of thermal expansion between the current conductor and the discharge vessel and providing a vacuumtight seal.

It was found that the first coating is attacked by sodium in the case of high-frequency operation of the lamp, for example at several kHz, for example 45 kHz, as a result of which the discharge vessel exhibits cracks in its pinch seals after a comparatively short operating period of two to three thousand hours already and becomes leaky. The low viscosity of the glass of the first coating during lamp manufacture, leading to an irregular thickness of the coating, and electrolytic processes taking place at high-frequency operation as a result are to blame for this.

A low-pressure mercury discharge lamp is known from U.S. Pat. No. 5,498,927 where a first coating of the current conductor made from sodium-resistant glass of low viscosity at the pinching temperature extends from inside the discharge vessel through the pinch seal to outside the discharge vessel. The first coating is surrounded by a second coating of the more viscous glass from which the discharge vessel is made from inside the pinch seal to outside the discharge vessel. The second coating protects the first coating while the pinch seal is being made, so that the first coating has a more homogeneous thickness and is better resistant to high-frequency operation. It was found, however, that it is difficult to manufacture the lamp according to this Patent in an industrial process.

A low-pressure sodium discharge lamp is known from JP-A-49[1974]-33870, where the current conductors each have only one coating of borate glass which extends from inside the discharge vessel through the pinch seal to outside the discharge vessel. The lamp known from this document was found to become leaky prematurely in the case of high-frequency operation.

It is an object of the invention to provide a low-pressure sodium discharge lamp of the kind described in the opening paragraph which is of a simple, mechanically strong construction which can be readily manufactured on an industrial scale and which is resistant to sodium also in high-frequency operation.

According to the invention, this object is achieved in that the first glass coating is made from a glass comprising the following constituents in % by weight: $SiO_2$ 30–50; $Al_2O_3$ 5–10; $ZrO_2$ 2–6, with the total quantity of $Al_2O_3$ and $ZrO_2$ being 7–15; $Li_2O$ 1–4; $Na_2O$ 4–7; $K_2O$ 0–0.5; MgO plus CaO in a total quantity of 8–12; SrO 3–9; BaO 20–32; rest <1.

The low-pressure sodium discharge lamp according to the invention is of a mechanically strong construction which is readily obtained industrially. The lamp is resistant to sodium also in the case of high-frequency operation.

Each of the constituents of the glass of the first coating with its quantitative limits is of essential importance for the properties of the lamp. A too low $SiO_2$ content, i.e. a content lower than the bottom value indicated, involves the risk of the glass crystallizing, which renders it difficult or impossible to process. Stresses also arise in the glass then, involving the risk of cracks, owing to a too high coefficient of thermal expansion. If the $SiO_2$ content is too high, i.e. higher than the upper value indicated, the glass will have a bad sodium resistance. An $SiO_2$ content of 30 to 40% by weight is favorable for a high sodium resistance. If the quantity of $Al_2O_3$ plus $ZrO_2$ were to pass below the bottom limit indicated or above the upper limit indicated, thus increasing or decreasing the $SiO_2$ content, the glass would have a bad sodium resistance or crystallize, respectively. Too much of these oxides would make the melting point too high, so that the glass would be difficult to process. It is favorable for the sodium resistance when the sum of these oxides is 10–15% by weight. The values of $Li_2O$ are important on account of a too low coefficient of expansion and a too high melting point, respectively a too high coefficient of expansion, respectively crystallization. Relevant for $Na_2O$ are a too low coefficient of expansion and a too high electrical conductivity and accordingly a bad sodium resistance; for MgO, CaO, and SrO a bad sodium resistance, a too high melting point, and the risk of crystallization versus a too low melting point and crystallization; for BaO a bad sodium resistance and a too high melting point versus crystallization. If there is too much $K_2O$, the sodium resistance will be bad and potassium will be exchanged with sodium in the glass, so that potassium having a low efficacy will take part in the discharge. The residual content of the glass may be $SO_3$ and/or $Sb_2O_5$ originating from a purifying agent, and impurities such as $Fe_2O_3$, chlorides, fluorides, and the like.

It is favorable when the glass of the first glass coating has a composition of $SiO_2$ 37.1±3.0; $Al_2O_3$ 8.1±1.0; $ZrO_2$ 4.0±0.5; $Li_2O$ 2.3±0.2; $Na_2O$ 6.2±0.6; $K_2O$ 0.06±0.05; MgO 4.1±0.5; CaO 5.9±0.5; SrO 6.0±0.5; BaO 26.0±2; rest 0.24±0.1% by weight.

Figure 2:
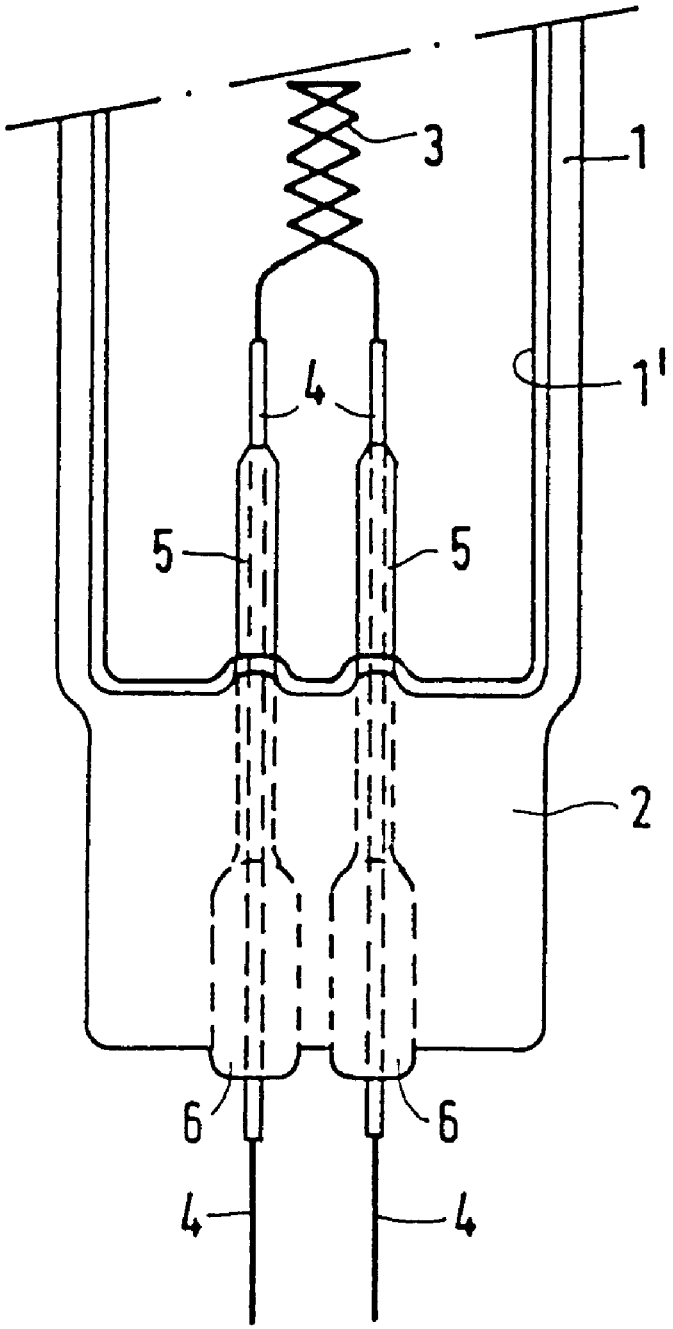

An embodiment of the low-pressure sodium discharge lamp according to the invention is shown in the drawing, in which FIG. 1 shows the lamp in side elevation, partly in cross-section; and FIG. 2 shows a detail of the discharge vessel of FIG. 1.

In FIG. 1, the low-pressure sodium discharge lamp has a discharge vessel 1 which is closed in a vacuumtight manner and which has pinch seals 2, see FIG. 2, and a filling comprising sodium and rare gas. Electrodes 3, made of tungsten in the Figures, are arranged in the discharge vessel 1 and are each connected to at least one corresponding current conductor 4 which issues through a pinch seal 2 to the exterior. Each electrode 3 in FIG. 2 is connected to two current conductors made of FeNiCr. The current conductors 4 each have a first, comparatively thin glass coating 5, having a wall thickness of approximately 0.3 mm in FIG. 2, which extends from the relevant pinch seal 2 to inside the discharge vessel 1, and a second, comparatively thick lime-barium glass coating 6, having a wall thickness of approximately 0.7 mm in the Figure. The second coating 6 has a butt joint against the first coating 5 and extends from the relevant pinch seal 2 to outside the discharge vessel 1. The discharge vessel 1, see FIG. 2, internally has a sodium-resistant coating 1'. An evacuated outer bulb 8 provided with an IR reflection filter 7, for example made of tin-doped indium oxide, surrounds the discharge vessel 1.

The first coating 5 is made from glass having a composition shown in column "5" in Table 1. In the embodiment shown, the glass has the composition of "5" example 1 ("5" ex 1) from the Table. An alternative is shown in column "5" example 2 ("5" ex 2). The Table further shows a composition "6" of the lime-barium glass of the second coating 6, the composition of the glass "1" of the discharge vessel 1, and the composition of the borate glass coating 1' on the inside of the discharge vessel 1.

A striking feature in the coatings 5 is the high content of $SiO_2$ plus $Al_2O_3$ plus $ZrO_2$ compared with the sodium-resistant glass 1' on the inside of the discharge vessel 1, and the substantial lack of $B_2O_3$.

Lamps as shown in the drawing and each provided with a first glass coating 5 having the composition of the examples of Table 1 were operated at high frequency. The lamps were still fully intact after 7000 hours of operation and showed no trace of electrolysis.

TABLE 1

| component\ glass | "5" | "5" ex 1 | "5" ex 2 | "6" | "1" | "1'" |
|---|---|---|---|---|---|---|
| $SiO_2$ | 30–50 | 37.1 | 43.7 | 66.3 | 63.3 | 5.7 |
| $Al_2O_3$ | 5–10 | 8.1 | 5.0 | 2.4 | 4.7 | 9.2 |
| $ZrO_2$ | 2–6 | 4.0 | 3.0 | | | |
| $Al_2O_3$ + $ZrO_2$ | 7–15 | 12.1 | 8.0 | | | |
| $Li_2O$ | 1–4 | 2.3 | 3.0 | | | |
| $Na_2O$ | 4–7 | 6.2 | 5.0 | 7.0 | 17.1 | |
| $K_2O$ | 0–0.5 | 0.06 | 0.05 | 8.8 | 0.7 | |
| MgO + CaO | 8–12 | 10.0 | 10.0 | | | |

TABLE 1-continued

| component\ glass | "5" | "5" ex 1 | "5" ex 2 | "6" | "1" | "1'" |
|---|---|---|---|---|---|---|
| MgO | | 4.1 | 4.1 | | 3.1 | 5.0 |
| CaO | | 5.9 | 5.9 | | 4.7 | 10.0 |
| SrO | 3–9 | 6.0 | 4.0 | 0.25 | | 1.1 |
| BaO | 20–32 | 26.0 | 26.0 | 13.6 | 5.2 | 50.4 |
| $B_2O_3$ | | | | 1.5 | 0.8 | 18.5 |
| rest | <1 | $SO_3$ 0.16 $Fe_2O_3$ 0.08 | $SO_3$ 0.16 $Fe_2O_3$ 0.07 0.02 | F 0.1 0.05 | $SO_3$ 0.07 0.33 | 0.1 |

We claim:

1. A low-pressure sodium discharge lamp comprising:

a discharge vessel (1) with pinch seals (2) which is closed in a vacuumtight manner and which has a filling comprising sodium and rare gas;

electrodes (3) arranged in the discharge vessel (1) and each electrode connected to at least one corresponding current conductor (4) which issues through a pinch seal (2) to the exterior, which current conductors (4) each have a first, comparatively thin glass coating (5) which extends from the relevant pinch seal (2) to inside the discharge vessel, and a second, comparatively thick coating (6) of lime-barium glass abutting the first coating (5) and extending from said pinch seal (2) to outside the discharge vessel (1); and an evacuated outer bulb (8) surrounding the discharge vessel (1) and provided with an IR reflection filter (7), characterized in that the first glass coating (5) is made from a glass comprising the following constituents in % by weight: $SiO_2$ 30–50; $Al_2O_3$ 5–10; $ZrO_2$ 2–6, with the total quantity of $Al_2O_3$ and $ZrO_2$ being 7–15; $Li_2O$ 1–4; $Na_2O$ 4–7; $K_2O$ 0–0.5; MgO plus CaO in a total quantity of 8–12; SrO 3–9; BaO 20–32; rest <1.

2. A low-pressure sodium discharge lamp as claimed in claim 1, characterized in that $Al_2O_3$ plus $ZrO_2$ accounts for 10–15% by weight of the glass of the first glass coating (5), and $SiO_2$ for 30–40% by weight thereof.

3. A low-pressure sodium discharge lamp as claimed in claim 2, characterized in that the glass of the first glass coating (5) has a composition of $SiO_2$ 37.1±3.0; $Al_2O_3$ 8.1±1.0; $ZrO_2$ 4.0±0.5; $Li_2O$ 2.3±0.2; $Na_2O$ 6.2±0.6; $K_2O$ 0.06±0.05; MgO 4.1±0.5; CaO 5.9±0.5; SrO 6.0±0.5; BaO 26.0±2; rest 0.24±0.1% by weight.

* * * * *